US007612739B2

(12) United States Patent
Choi

(10) Patent No.: US 7,612,739 B2
(45) Date of Patent: Nov. 3, 2009

(54) DEVICE AND METHOD FOR OPERATING PLASMA DISPLAY PANEL

(75) Inventor: Jeong Pil Choi, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 10/419,110

(22) Filed: Apr. 21, 2003

(65) Prior Publication Data

US 2003/0197661 A1 Oct. 23, 2003

(30) Foreign Application Priority Data

Apr. 22, 2002 (KR) ..... 10-2002-0021871

(51) Int. Cl.
*G09G 3/28* (2006.01)

(52) U.S. Cl. ..... 345/63; 345/60

(58) Field of Classification Search ..... 345/60
See application file for complete search history.

(56) References Cited

U.S. PATENT DOCUMENTS

| | | | | |
|---|---|---|---|---|
| 6,262,699 | B1 * | 7/2001 | Suzuki et al. | 345/68 |
| 6,323,880 | B1 * | 11/2001 | Yamada | 345/690 |
| 6,340,960 | B1 * | 1/2002 | Song et al. | 345/60 |
| 6,531,994 | B1 * | 3/2003 | Nagano | 345/60 |
| 2002/0097202 | A1 * | 7/2002 | Park | 345/60 |

FOREIGN PATENT DOCUMENTS

| | | |
|---|---|---|
| JP | H09-097570 | 4/1997 |
| JP | H11-065486 | 3/1999 |
| JP | 2002-258797 | 9/2002 |

* cited by examiner

*Primary Examiner*—Sumati Lefkowitz
*Assistant Examiner*—Ke Xiao
(74) *Attorney, Agent, or Firm*—KED & Associates LLP

(57) ABSTRACT

Device and method for operating a plasma display panel, wherein scan electrode lines are equally divided into two, and independently operated, and a scanning sequence of the scan electrode lines is alternated at every sub-field.

20 Claims, 11 Drawing Sheets

DEVICE AND METHOD FOR OPERATING PLASMA DISPLAY PANEL

This application claims the benefit of the Korean Application No. P2002-21871 filed on Apr. 22, 2002, which is hereby incorporated by reference.

BACKGROUND OF THE INVENTION

1. Field of the Invention

The present invention relates to plasma display devices, and more particularly, to device and method for operating a plasma display panel.

2. Background of the Related Art

In general, the plasma display panel (hereafter called as "PDP") makes fluorescent material to emit a light by using a UV beam emitted when an inert gas, such as He+Xe, Ne+Xe, or He+Xe+Ne, discharges, for displaying a picture. The PDP is, not only easy to fabricate a thin and large sized device, but also under improvement of a picture quality owing to recent development of technologies.

Referring to FIG. 1, a unit discharge cell of the PDP is provided with a scan electrode Y and a common sustain electrode Z formed in parallel under an upper substrate 10, and an address electrode X on the lower substrate 18. The scan electrode Y is provided with a transparent electrode Ya and a metal bus electrode Yb having a width smaller than the transparent electrode Ya, and the common sustain electrode Z is provided with a transparent electrode Za and a metal bus electrode Zb having a width smaller than the transparent electrode Za. The transparent electrodes Ya and Za are in general formed of Indium-Tin-Oxide (ITO), and the metal bus electrodes Yb and Zb are in general formed of a metal such as chrome, each for reducing a voltage drop caused by the transparent electrode Ya or Za.

There are an upper dielectric layer 14 and a protection film 16 stacked on the upper substrate 10. The upper dielectric layer 14 accumulates wall charges generated at the time of plasma discharge, and the protection film 16 prevents the upper dielectric layer 14 suffering from damage occurred at the time of the plasma discharge, and enhances a discharge efficiency of secondary electrons. The protection film 16 is in general formed of magnesium oxide MgO.

There are a lower dielectric layer 22 and a barrier 24 on the lower substrate 18 having the address electrode X formed thereon, and a fluorescent material layer 26 is coated on surfaces of the lower dielectric layer 22 and the barrier 24. The address electrode X is formed to cross the scan electrode Y and the common sustain electrode Z. The barrier 24 is formed parallel to the address electrode X for prevention of leakage of the UV ray and visible light emitted by discharge to adjoining discharge cells. The fluorescent material layer 26 emits one of red, green and blue visible light by the UV ray emitted at the time of the plasma discharge.

For making the PDP to display gray levels of the picture, one frame is time divided into sub-fields each having different number of light emission times. The sub-field has a reset period for resetting an entire screen, an address period for selecting a scan line and selecting a cell on the selected scan line, and a sustain period for displaying a gray level according to the number of discharge times.

In the address period, a scan pulse is provided to the scan electrode Y, and a data pulse is provided to the address electrode X in synchronization to the scan pulse. In this instance, an address discharge is occurred at the discharge cell having the scan pulse and the data pulse provided thereto. After the scan pulse is provided to all the scan electrodes Y, the sustain pulse is provided to the scan electrode Y and the common sustain electrode Z alternately. Thereafter, sustain discharges are occurred at the discharge cells at which the address discharges are occurred.

For an example, referring to FIG. 3, if it is intended to display the picture with 256 gray levels, a frame period (16.67 ms=1/60 second) is divided into 8 sub-fields SF1~SF8. As described, each of the 8 sub-fields SF1~SF8 has the reset period, the address period, and the sustain period. Though the reset periods, and the address periods are identical between the sub-fields, a number of the sustain pulses assigned to the sustain period increases in a rate of $2^n$ (n=0, 1, 2, 3, 4, 5, 6, and 7).

Referring to FIG. 2, since the related art PDP is operated by single scan method in which the scan electrode lines Y1~Yn are scanned one by one in succession, the related art PDP requires a long address period. Consequently, since it is required to reduce a time period allocated to the sustain period following the address period, a high luminance is not available from the PDP. For solving the problems, a dual scan method rises, in which the scan electrode lines are divided into upper scan electrode lines and lower scan electrode lines, equally.

However, the related art dual scan method has a problem in that the PDP causes high temperature mis-discharge at a high temperature. As shown in FIG. 4, the high temperature mis-discharge is a phenomenon in which some of the cells 'A' are turned off when the PDP is operated at a high environmental temperature in a range of 50~70° C. The cells are turned off mostly in a central part because the high temperature mis-discharge is distinctive as time goes by after a set up discharge in a case the scan is directed toward the central part.

A major reason of the high temperature mis-discharge is failure of the address discharge caused by loss of wall charge during the address period. The wall charge loss during the address period is caused in the following two cases, mostly. First, insulating property of the protection film (MgO) and the dielectric layer becomes weak as inside and outside temperatures of the discharge cell 1 rise, to cause the wall charge leakage, particularly at the scan electrode Y and the sustain electrode Z. Second, when the PDP is at a high temperature, movements of spatial charges in the discharge cell become active such that re-bonding of the charges is vulnerable to cause a loss of the wall charges.

SUMMARY OF THE INVENTION

Accordingly, the present invention is directed to device and method for operating a plasma display panel that substantially obviates one or more of the problems due to limitations and disadvantages of the related art.

An object of the present invention is to provide device and method for operating a plasma display panel, in which a scan direction is changed at every sub-field and frame, for displaying a high quality and stable picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for operating a plasma display panel (PDP) having sustain electrode lines, address electrode lines, and scan electrode lines includes a Y operating part for providing a scan pulse to the scan electrode lines in a sequence, the sequence being changed at fixed intervals, a Z operating part for operating the sustain electrode lines, and an X operating part for operating the address electrode lines.

The Y operating part changes the sequence of providing the scan pulse to the scan electrode lines at every new sub-field.

In another aspect of the present invention, there is provided a device for operating a plasma display panel (PDP) having sustain electrode lines, upper and lower address electrode lines, and upper and lower scan electrode lines, including a first Y operating part for providing a scan pulse to the upper scan electrode lines in a sequence, the sequence being changed at fixed intervals, a second Y operating part for providing a scan pulse to the lower scan electrode lines in a sequence, the sequence being changed at fixed intervals, a Z operating part for operating the sustain electrode lines, a first X operating part for operating the upper address electrode lines, and a second X operating part for operating the lower address electrode lines.

The first or second Y operating part changes the sequence at every new sub-field, at every new group of sub-fields, or at every new frame.

In further aspect of the present invention, there is provided a method for operating a plasma display panel having sustain electrode lines, address electrode lines, and scan electrode lines, including the steps of (a) applying a scan pulse to the scan electrode lines progressively, and (b) applying a scan pulse to the scan electrode lines reverse progressively.

The scan pulse is applied to the scan electrode lines in a sequence changed at every new sub-field, a new group of sub-fields, or a new frame.

In still further aspect of the present invention, there is provided a method for operating a plasma display panel having sustain electrode lines, upper and lower address electrode lines, and upper and lower scan electrode lines, including the steps of (a) discharging all cells on a panel for resetting the panel, (b) scanning the upper scan electrode lines in a first scan direction and scanning the lower scan electrode lines in a second scan direction opposite to the first second direction, (c) applying a first sustain pulse to the upper and lower scan electrode lines and a second sustain pulse to the sustain electrode lines, (d) discharging all cells on the panel for resetting the panel, (e) scanning the upper scan electrode lines in the first scan direction and scanning the lower scan electrode lines in the first scan direction, and (f) applying a first sustain pulse to the upper and lower scan electrode lines and applying a second sustain pulse to the sustain electrode lines.

The scan direction of the upper and lower scan electrode lines is changed at every new sub-field, at a new group of sub-fields, or at a new frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 5:
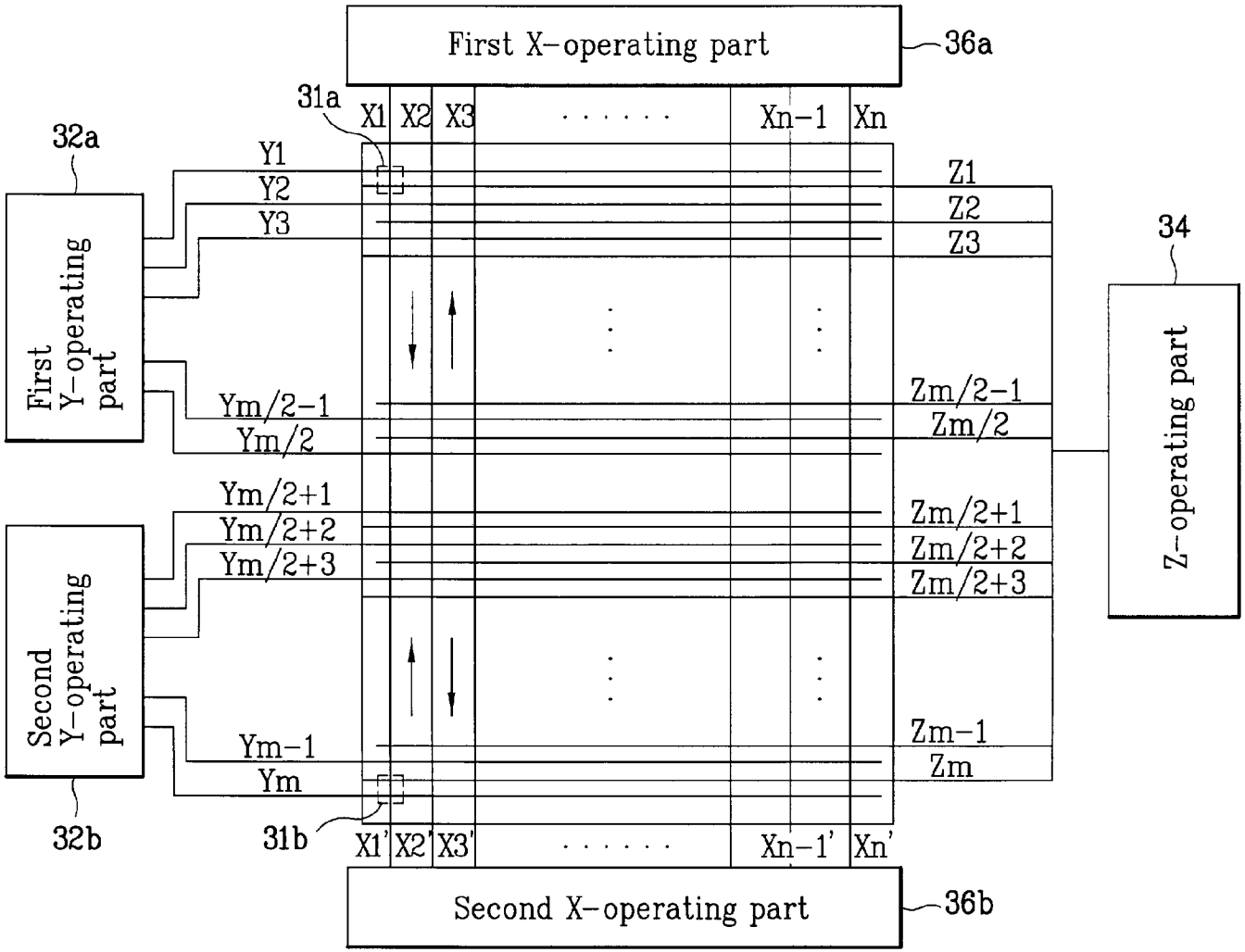
FIG. 5 illustrates an AC three electrode surface discharge type PDP in accordance with a preferred embodiment of the present invention, schematically.

Reference will now be made in detail to the preferred embodiments of the present invention, examples of which are illustrated in the accompanying drawings FIGS. 5~8A and 8B. FIG. 5 illustrates an AC three electrode surface discharge type PDP in accordance with a preferred embodiment of the present invention, schematically.

Referring to FIG. 5, the PDP of the present invention includes a plurality of discharge cells 31*a* and 31*b* positioned at every cross point of scan electrode lines Y1~Ym/common sustain electrode lines Z1~Zm with address electrode lines X1~Xn, and X1'~Xn'. The present invention suggests dividing the scan electrode lines Y1~Ym, the common sustain electrode lines Z1~Zm, and the address electrode lines X1~Xn, and X1'~Xn' into upper and lower ones which are operative independently.

Moreover, a PDP operating device of the present invention includes a first Y operating part 32*a* for operating upper scan electrode lines Y1~Ym/2 among 'm' scan electrode lines Y1~Ym, a second Y operating part 32*b* for operating the rest lower m/2 scan electrode lines Ym/2~Ym among the 'm' scan electrode lines Y1~Ym, a Z operating part 34 for operating 'm' common sustain electrode lines Z1~Zm, a first X operating part 36*a* for operating 'n' upper address electrode lines X1~Xn, and a second X operating part 36*b* for operating 'n' lower scan electrode lines X1'~Xn'.

The first Y operating part 32*a* provides set up/set down waveforms RP and −RP to the upper scan electrode lines Y1~Ym/2 during a reset period of each of the sub-fields for resetting the screen, and a scan pulse SP to the upper scan electrode lines Y1~Ym/2 during the address period for scanning the scan electrode lines Y1~Ym/2. In this instance, the first Y operating part 32*a* alternates a progressive scanning and a reverse progressive scanning for the sub-fields or the frames in providing the scan pulse SP to the upper scan electrode lines Y1~Ym/2. For an example, during the address period of an (n)th sub-field, the scan pulse SP is provided to the scan electrode line Y1 at first, and provided to the scan electrode line Ym/2 finally, and during the address period of an (n+1)th sub-field, the scan pulse SP is provided to the scan electrode line Ym/2 at first, and provided to the scan electrode line Y1 finally. For causing a sustain discharge, the first Y operating part 32*a* also provides a sustain pulse SUSPy to the upper scan electrode lines Y1~Ym/2 during the sustain period of each sub-field.

The second Y operating part, synchronous to the first Y driving part 32*a*, provides set up/set down waveforms RP and −RP to the lower scan electrode lines Ym/2+1~Ym during a reset period of each sub-field for resetting the screen, and a scan pulse SP during the address period. In this instance, the second Y operating part 32*b* alternates a reverse progressive scanning and a progressive scanning for the sub-fields or the frames in providing the scan pulse SP to the lower scan electrode lines Ym/2+1~Ym. In other words, the second Y operating part 32*b* scans the lower scan electrode lines Ym/2+1~Ym opposite to a scan direction of the first Y operating part 32*a*. For causing a sustain discharge, the second Y operating part 32*b* also provides a sustain pulse SUSPy to the lower scan electrode lines Y1~Ym/2 during the sustain period of each sub-field.

The Z operating part 34 is connected to the sustain electrode lines Z1~Zm in common for supplying a scan DC voltage Zdc and a sustain pulse SUSPz to the sustain electrode lines Z1~Zm in a sequence.

The first X operating part 36*a* provides a data pulse DP to the upper address lines X1~Xn in synchronization to the scan pulse SP from the first Y operating part 32*a*, and the second X operating part 36*b* provides the data pulse DP to the lower address lines X1'~Xn' in synchronization to the scan pulse SP from the second Y operating part 32*b*.

Figure 1:
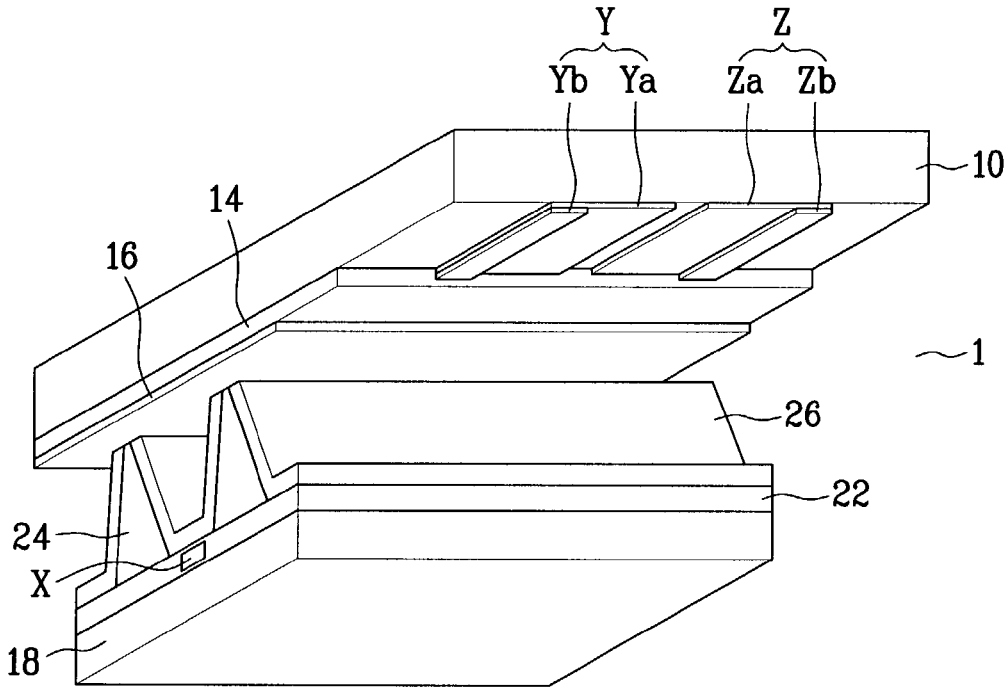
FIG.1 Background Art
FIG. 1 illustrates a perspective view showing a discharge cell structure of a related art PDP.
Figure 2:
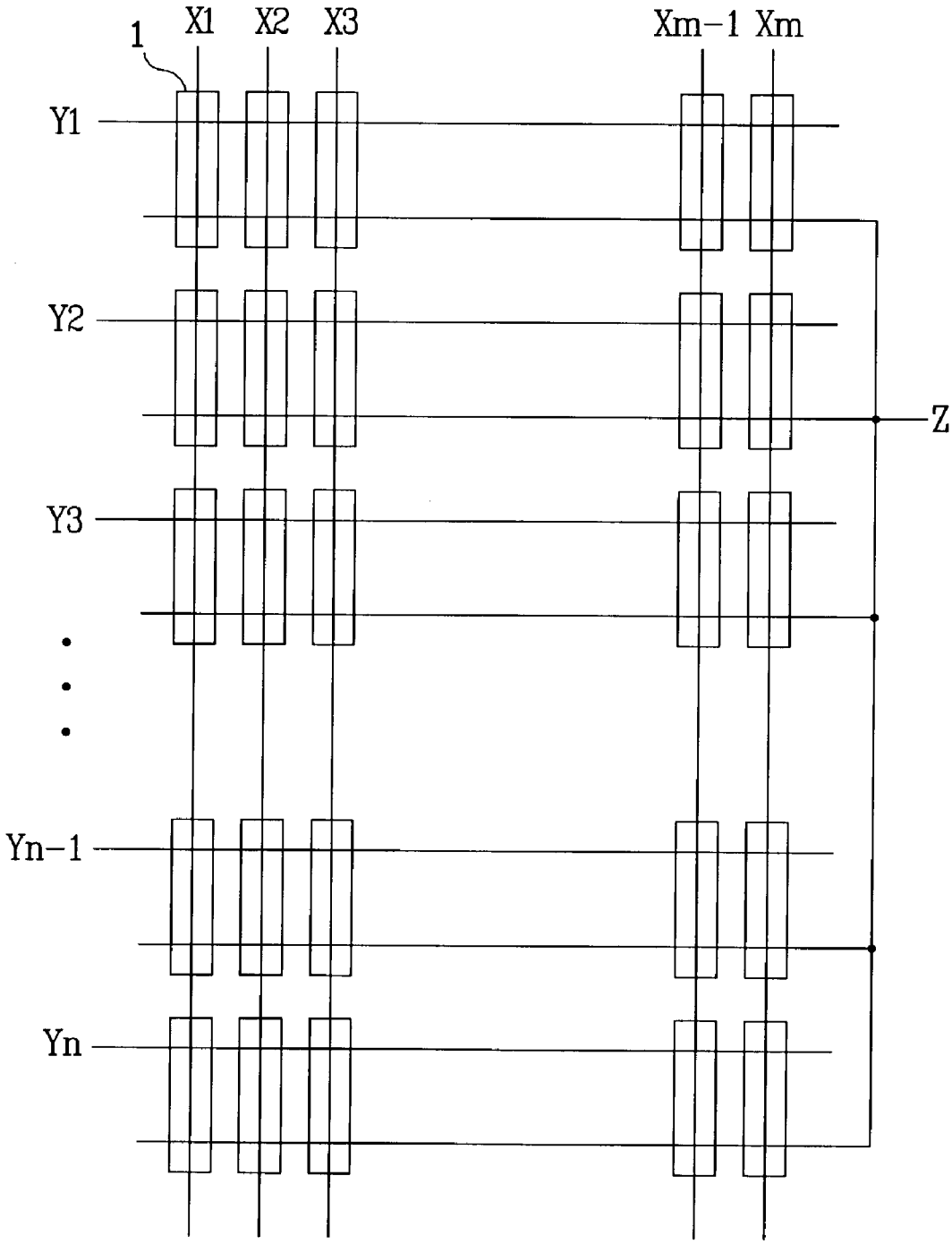
FIG.2 Background Art
FIG. 2 illustrates a related art AC three electrode surface discharge type PDP, schematically.
Figure 3:
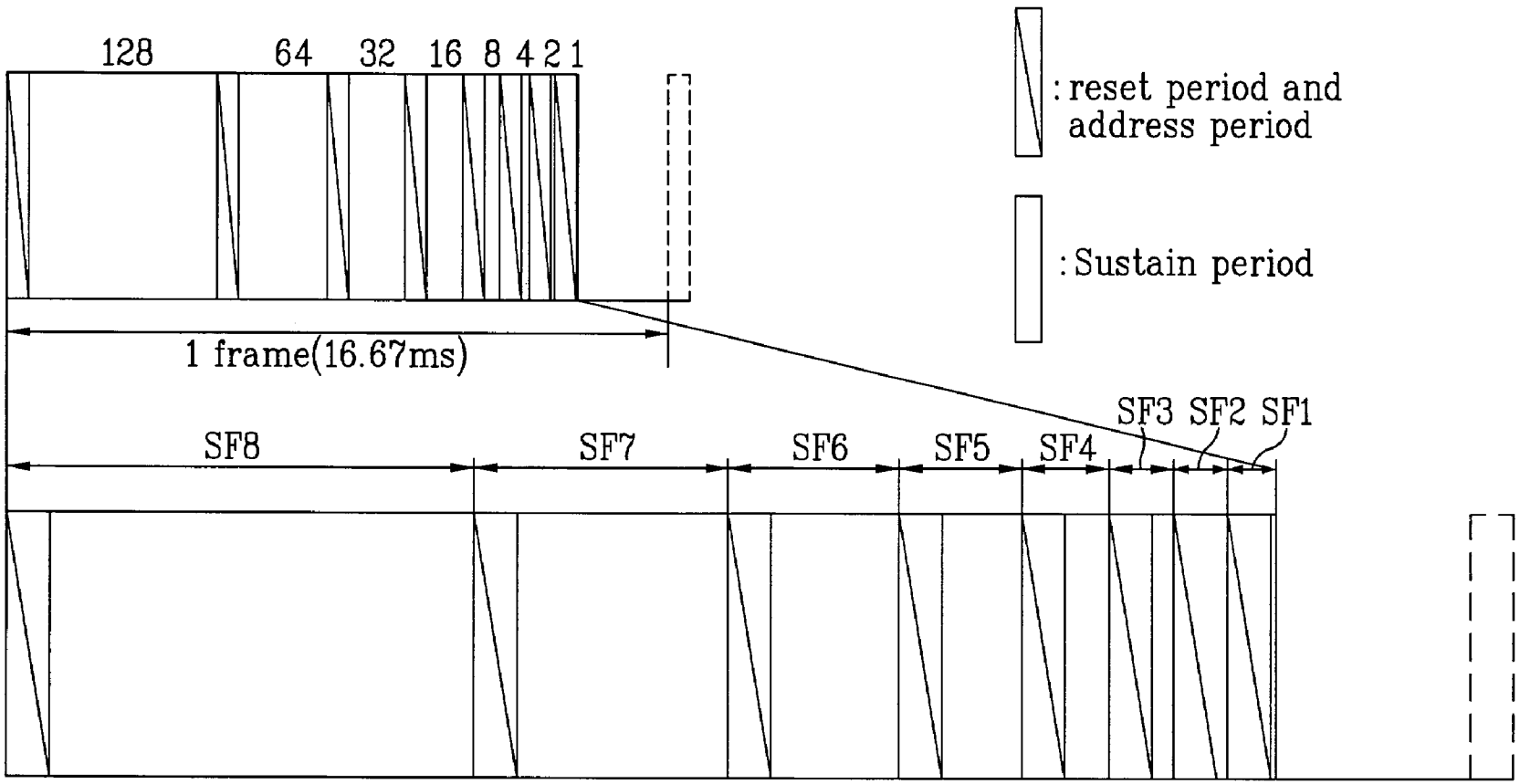
FIG.3 Background Art
FIG. 3 illustrates a frame structure of 8 bit default code.
Figure 4:
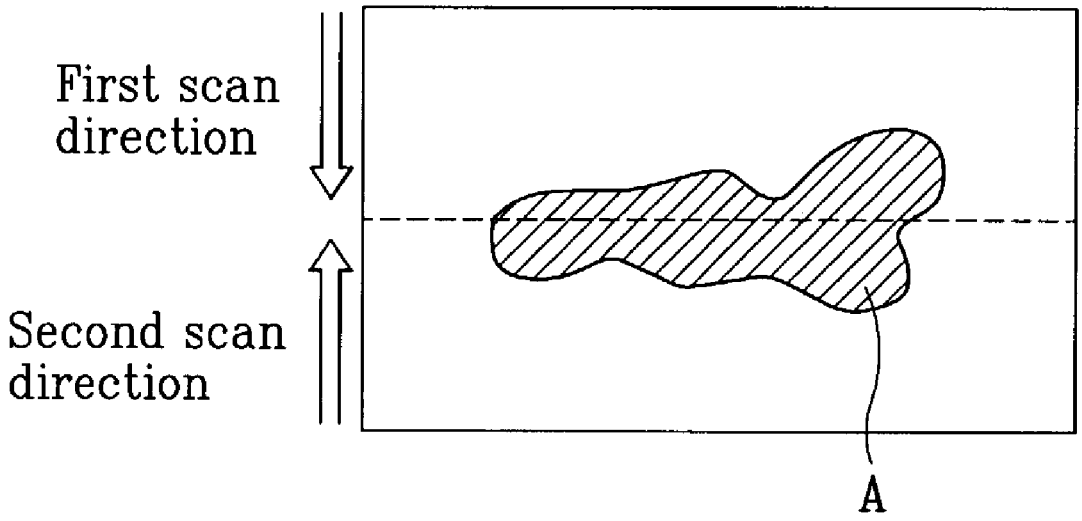
FIG. 4 illustrates a high temperature mis-discharge occurred when a related art PDP is operated at a high temperature according to a related art PDP operating method.

For the PDP operated by the operating device to display gray levels of the picture, one frame is time divided into sub-fields having different number of light emission times. The sub-field is divided into a reset period for resetting an entire screen, an address period for selecting a scan electrode line and selecting a cell on the selected scan electrode line, and a sustain period for displaying gray levels according to a number of discharge times. For an example, as shown in FIG. 3, when it is intended to display a picture with 256 gray levels, one frame period (16.67 ms=1/60 second) is divided into 8 sub-fields SF1~SF8. As described, each of the 8 sub-fields SF1~SF8 is divided into the reset period, the address period, and the sustain period. Though reset periods and the address periods of the sub-fields are identical for all the sub-fields, the sustain period and a number of sustain pulses assigned to the sustain period increase at a rate of $2^n$ (n=0, 1, 2, 3, 4, 5, 6, and 7) in each of the sub-fields.

Embodiments of a method for operating a PDP of the present invention by using the device for operating a PDP of the present invention will be described.

First Embodiment

Figure 6:
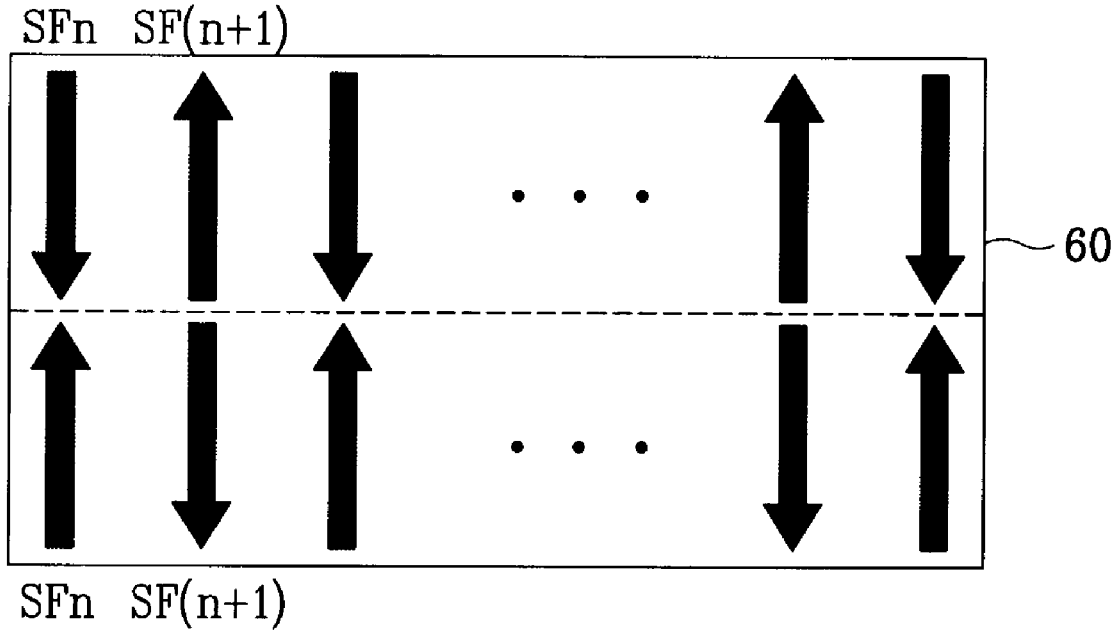
FIG. 6 illustrates a method for operating a PDP in accordance with a preferred embodiment of the present invention, schematically.
Figure 7A:
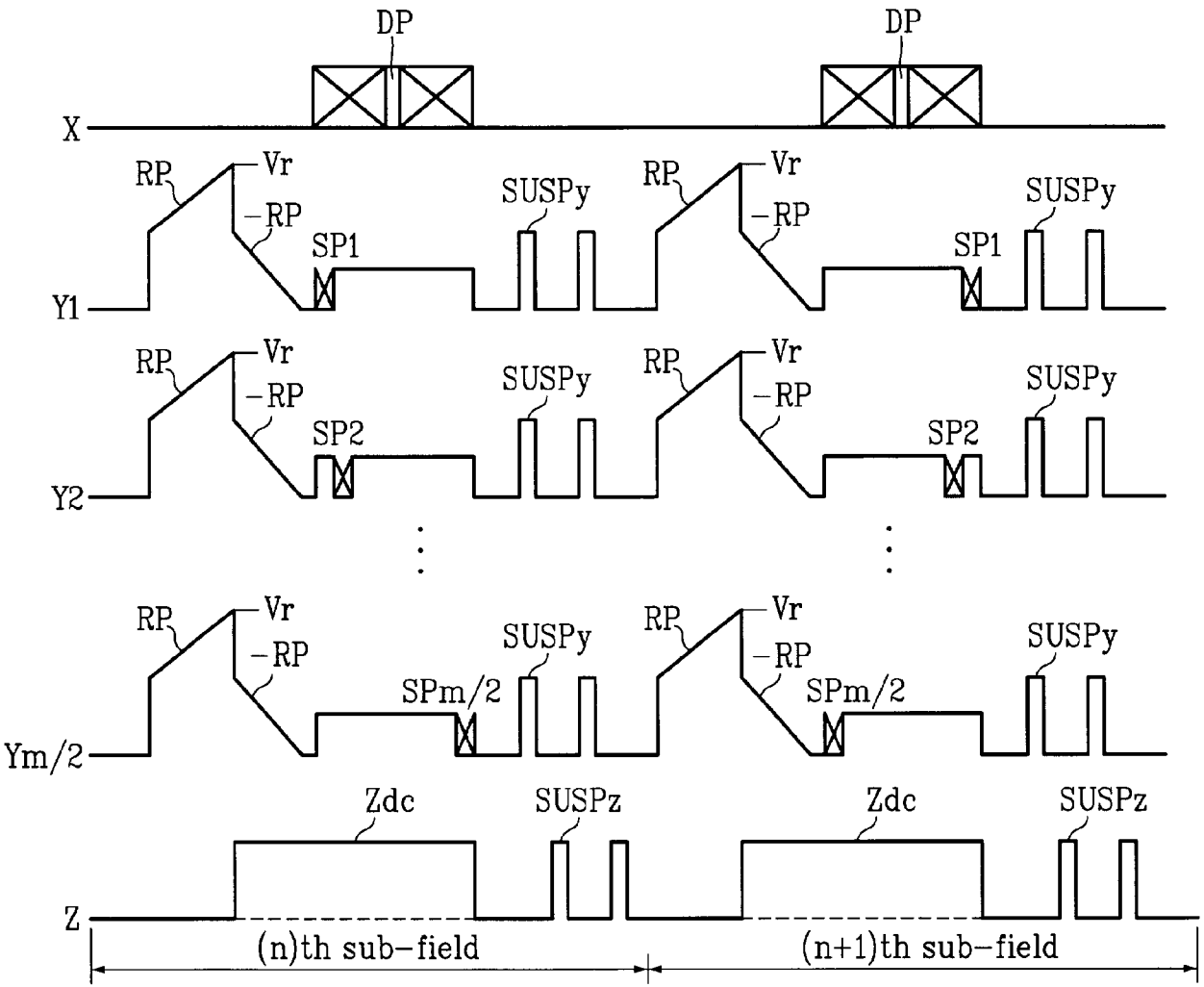
FIGS. 7A and 7B illustrate operative waveforms in a method for operating a PDP in accordance with a first preferred embodiment of the present invention.
Figure 7B:
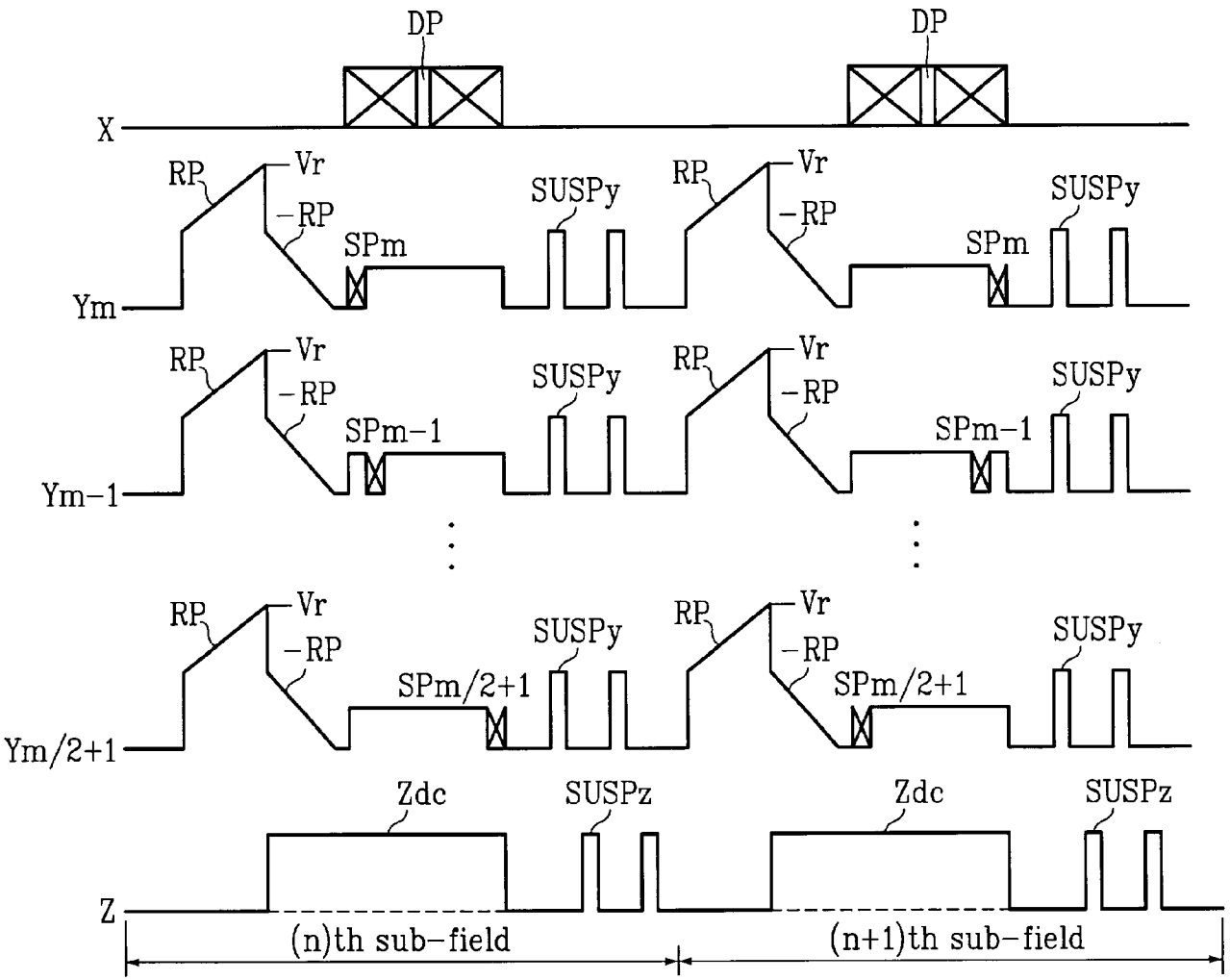

FIG. 6 illustrates a method for operating a PDP in accordance with a preferred embodiment of the present invention schematically, and FIGS. 7A and 7B illustrate operative waveforms in a method for operating a PDP in accordance with a first preferred embodiment of the present invention.

Referring to FIG. 6, in the method for operating a PDP in accordance with a first preferred embodiment of the present invention, upper scan electrode lines Y1~Ym/2 and lower scan electrode lines Ym/2+1~Ym, an equal division of scan electrode lines Y1~Ym, are operable independently, each one of the upper scan electrode lines Y1~Ym/2 and the lower scan electrode lines Ym/2+1~Ym are scanned at a time, and a sequence of scanning of the scan electrode lines Y1~Ym is alternated whenever the scanning is turned to a next sub-field. The scanning progresses from outside to a center of a panel 60 in an (n)th sub-field SFn, and from the center to the outside of the panel 60 in an (n+1)th sub-field SF(n+1).

Each of the (n)th sub-field SFn and the (n+1)th sub-field SF(n+1) in FIGS. 7A and 7B has a reset period for resetting a screen, an address period for selecting a cell, and a sustain period for sustaining a discharge of a selected cell.

The reset period of the (n)th sub-field SFn has a set up period and a set down period, wherein, in the set up period, a ramp up RP waveform is provided to both of the upper and lower scan electrode lines Y1~Ym/2, and Ym/2+1~Ym at the same time, so as to cause discharge in all the cells, i.e., entire panel, that is called as a set up discharge. The set up discharge makes wall charges of positive polarity (+) to be accumulated both on the address lines X1~Xn, and the sustain electrode lines Z1~Zm, and wall charges of negative polarity (−) to be accumulated on the scan electrode lines Y1~Ym.

After the ramp up waveform RP is provided to the scan electrode lines Y1~Ym, in the set down period, a ramp down waveform −RP lower than a peak voltage Vr of the ramp up waveform RP is provided both to the upper and lower scan electrode lines Y1~Ym/2, and Ym/2+1~Ym at the same time. The ramp down waveform −RP make the cells to discharge little by little for removing some of the wall charges formed at the cells excessively, that is called as a set down discharge. The set down discharge makes an amount of the wall charges enough to cause a stable address discharge later to remain in the cells uniformly. In this instance, the ramp down waveform −RP transits down to a ground voltage level GND. In the set down period, during the ramp down waveform −RP is provided to the scan electrode lines Y1~Ym, a DC voltage Zdc of positive polarity (+) is provided to the sustain electrode lines Z1~Zm.

During the address period of the (n)th sub-field SFn, a scan pulse SP of negative polarity (−) is provided to the upper scan electrode lines Y1~Ym progressively, and to the lower scan electrode lines Ym/2+1~Ym reverse progressively. In other words, the first Y operating part 32*a* scans from the scan electrode line Y1 to the scan electrode line Ym/2 in the order, and the second Y operating part 32*b* scans from the scan electrode line Ym to the scan electrode line Ym/2+1 in the order. At the same time with this, a data pulse DP of positive polarity synchronous to the scan pulse SP is provided to the address electrode lines X1~Xn.

Thereafter, a voltage difference of the scan pulse SP and the data pulse DP and a voltage of the wall charge generated during the reset period are added, to cause an address discharge at the cell the data pulse DP is provided thereto. In cells selected by the address discharges, an amount of wall charges enough to cause a discharge when the sustain voltage is provided thereto is formed. A DC voltage Zdc Z1~Zm during the address period.

During the sustain period of the (n)th sub-field SFn, the sustain pulse SUSPy and the sustain pulse SUSPz are provided to the upper/lower scan electrode lines Y1~Ym/2 and Ym/2+1~Ym and the sustain electrode lines Z1~Zm alternately. When a voltage of the wall charges in the cell and the sustain pulse SUSPy or SUSPz are added, a sustain discharge, i.e., a display discharge is occurred between the upper/lower scan electrode lines Y1~Ym/2 and Ym/2+1~Ym and the sustain electrode lines Z1~Zm at the cells selected by the address discharge every time the sustain pulse SUSPy or SUSPz is provided thereto. The sustain pulse SUSPy or SUSPz has a pulse width in a range of 2~3 μs for securing stable discharge of the cell. Because, though the discharge occurs within apporx. 0.5~1 μs after generation of the pulse SUSPy or SUSPz, it is required that the cell is sustained at the sustain voltage Vs for approx. 2~3 μs so that the sustain pulse SUSPy or SUSPz forms an amount of wall charges at the cell enough to cause a next discharge after the sustain discharge.

After the sustain discharge is finished in the (n)th sub-field SFn, a ramp waveform (not shown) having a small pulse width and a low voltage level is provided to the sustain electrode lines Z1~Zm, which erases the wall charges remained in all the cells. That is, when the ramp waveform is provided to the sustain electrode lines Z1~Zm, a potential difference between the sustain electrode lines Z1~Zm and the scan electrode lines Y1~Ym becomes greater gradually, to cause weak discharges between the sustain electrode lines Z1~Zm and the scan electrode lines Y1~Ym continuously. The weak discharges erase the wall charges present in the cells having the sustain discharge occurred therein.

The reset period of the (n+1)th sub-field SF(n+1), which is a next sub-field, has a set up period and a set down period. In the set up period, a ramp up RP waveform is provided to the upper and lower scan electrode lines Y1~Ym/2, and Ym/2+1~Ym at the same time, so as to cause discharge in all the cells. The set up discharge makes wall charges of positive polarity (+) to be accumulated both on the address lines X1~Xn, and the sustain electrode lines Z1~Zm, and wall charges of negative polarity (−) to be accumulated on the scan electrode lines Y1~Ym.

In the set down period, a ramp down waveform −RP lower than a peak voltage Vr of the ramp up waveform RP is provided both to the upper and lower scan electrode lines Y1~Ym/2, and Ym/2+1~Ym at the same time. The ramp down waveform −RP causes weak discharge from the cells for removing some of the wall charges excessively formed at the cells. The set down discharge makes an amount of the wall charges enough to cause a stable address discharge to remain in the cells uniformly. In this instance, the ramp down waveform −RP drops down to a ground voltage level GND. In the set down period, during the ramp down waveform −RP is provided to the scan electrode lines Y1~Ym, a DC voltage Zdc of positive polarity (+) is provided to the sustain electrode lines Z1~Zm.

During the address period of the (n+1)th sub-field SF(n+1), the scan pulse is provided to the upper and lower scan electrodes Y1~Ym/2 and Ym/2+1~Ym in a sequence opposite to the scan pulse SP provided to the upper and lower scan electrodes Y1~Ym/2 and Ym/2+1~Ym in the address period of the (n)th sub-field SFn. That is, a scan pulse SP of negative polarity (−) is provided to the upper scan electrode lines Y1~Ym reverse progressively, and to the lower scan electrode lines Ym/2+1~Ym progressively. At the same time with this, a data pulse DP of positive polarity synchronous to the scan pulse SP is provided to the address electrode lines X1~Xn.

Thereafter, a voltage difference of the scan pulse SP and the data pulse DP and a voltage of the wall charge generated during the reset period are added, to cause an address discharge at the cell the data pulse DP is provided thereto. In cells selected by the address discharges, an amount of wall charges enough to cause a discharge when the sustain voltage is provided thereto is formed. A DC voltage Zdc Z1~Zm during the address period.

During the sustain period of the (n+1)th sub-field SF(n+1), the sustain pulse SUSPy and the sustain pulse SUSPz are provided to the upper/lower scan electrode lines Y1~Ym/2 and Ym/2+1~Ym and the sustain electrode lines Z1~Zm alternately. When a voltage of the wall charges in the cell and the sustain pulse SUSPy or SUSPz are added, a sustain discharge, i.e., a display discharge is occurred between the upper/lower scan electrode lines Y1~Ym/2 and Ym/2+1~Ym and the sustain electrode lines Z1~Zm at the cells selected by the address discharge every time the sustain pulse SUSPy or SUSPz is provided thereto. The sustain pulse SUSPy or SUSPz has a pulse width in a range of 2~3 μs for securing stable discharge of the cell.

After the sustain discharge is finished in the (n+1)th sub-field SF(n+1), a ramp waveform (not shown) having a small pulse width and a low voltage level is provided to the sustain electrode lines Z1~Zm, which erases the wall charges remained in all the cells.

The foregoing method for operating a PDP in accordance with a first preferred embodiment of the present invention can prevent the high temperature mis-discharge caused by one directional scanning since the first embodiment method of the present invention provides scan pulse progressively or reverse progressively to the upper and lower scan electrode lines Y1~Ym/2 and Ym/2+1~Ym depending on the sub-fields.

Second Embodiment

Figure 8A:
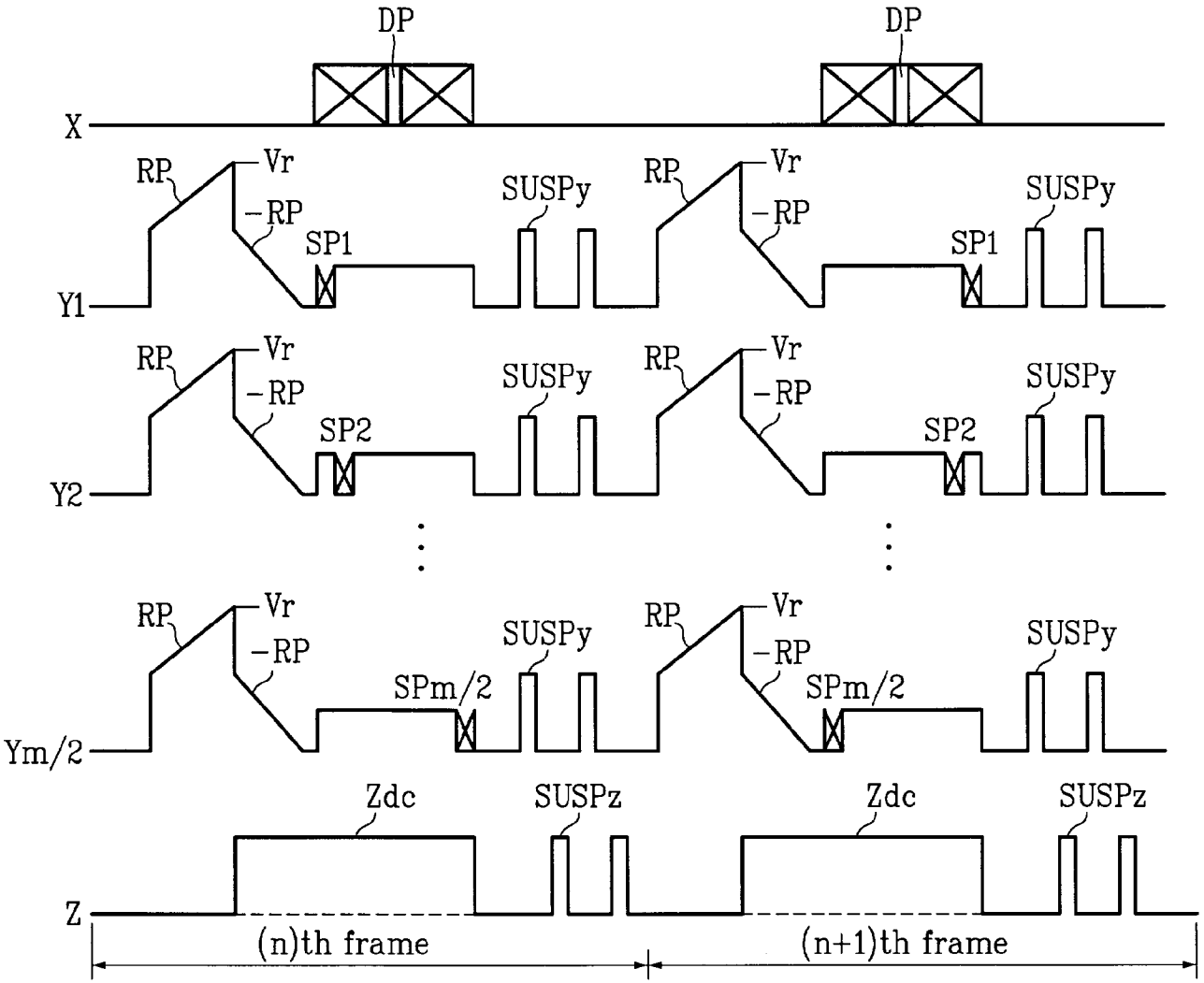
FIGS. 8A and 8B illustrate operative waveforms in a method for operating a PDP in accordance with a second preferred embodiment of the present invention.
Figure 8B:
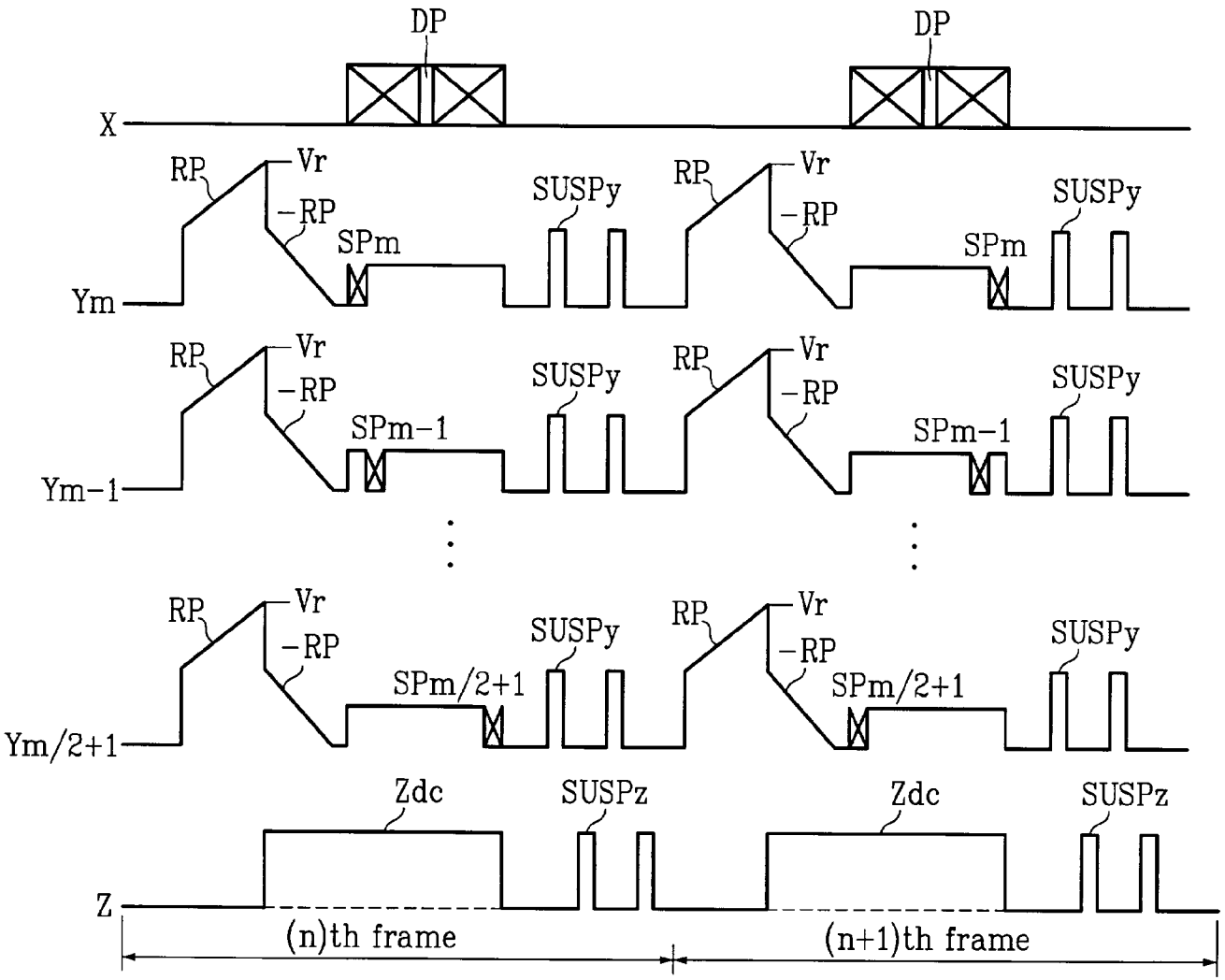

FIGS. 8A and 8B illustrate operative waveforms in a method for operating a PDP in accordance with a second preferred embodiment of the present invention.

In the method for operating a PDP in accordance with a second preferred embodiment of the present invention, a scanning direction is changed whenever the scanning is turned to a next frame. Though similar to the first embodiment in FIGS. 7A~7B, the second embodiment method for operating a PDP changes the scanning direction, not whenever the sub-field is changed, but whenever the frame is changed. That is, the scanning sequence is changed, not every time the sub-field is changed, but every time a preset number of sub-fields are changed. For an example, when the frame has 8 sub-fields, the scanning sequence is changed in an 8 sub-filed period.

Each of the (n)th frame and (n+1)th frame in FIGS. 8A and 8B are time divided into a plurality of sub-fields. Each of the sub-fields are divided into a rest period, an address period, and a sustain period.

A sequence of scanning of the scan electrode lines Y1~Ym in the (n)th frame and the sequence of scanning of the scan electrode line Y1~Ym in the (n+1)th frame are opposite. For an example, in all sub-fields of the (n)th frame, the scan pulse SP is provided to the upper scan electrode lines Ym/1~Ym/2 progressively, and the scan pulse SP is provided to the lower scan electrode lines Ym/2+1~Ym reverse progressively. However, in all sub-fields of the (n+1)th frame, the scan pulse SP is provided to the upper scan electrode lines Ym/1~Ym/2 reverse progressively, and the scan pulse SP is provided to the lower scan electrode lines Ym/2+1~Ym progressively.

Accordingly, alike the first embodiment, the second embodiment method for operating a PDP has an advantage of preventing the high temperature mis-discharge.

As a variation of the second embodiment of the present invention, the sub-fields may be grouped into groups each having a preset number of sub-fields, the scanning direction is changed whenever the scanning is turned to a next group of sub-fields. Alike the first, or second embodiment, by changing the direction of scanning at fixed intervals, a uniform screen can be displayed even in a high temperature state.

Third Embodiment

Figure 9:
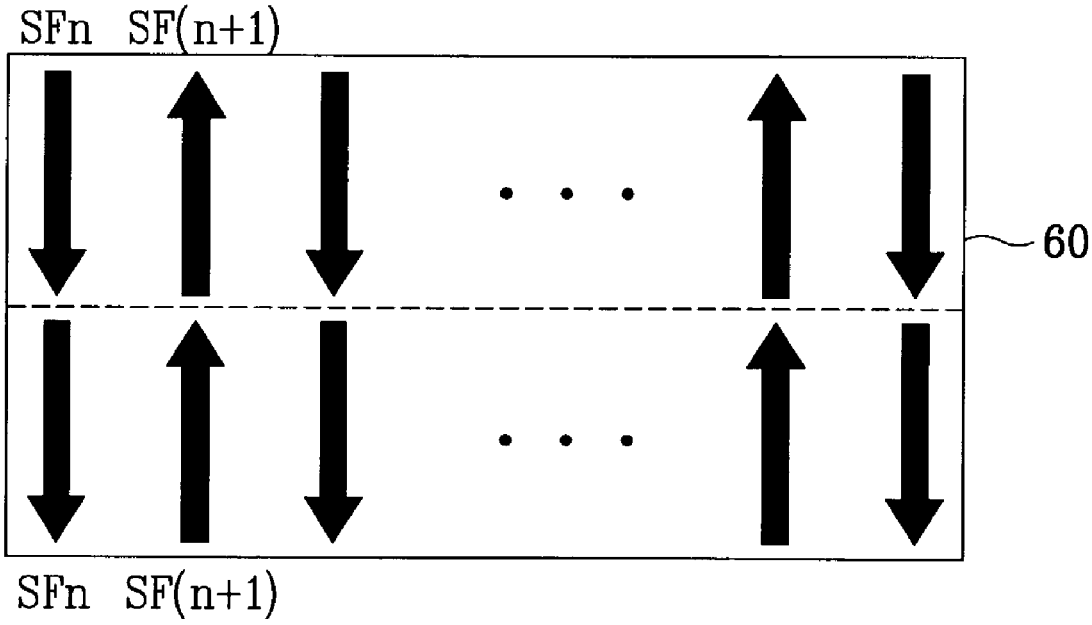
FIG. 9 illustrates operative waveforms in a method for operating a PDP in accordance with a third preferred embodiment of the present invention.

FIG. 9 illustrates operative waveforms in a method for operating a PDP in accordance with a third preferred embodiment of the present invention, schematically.

Referring to FIG. 9, in the third embodiment method for operating a PDP, a scanning direction of each of the upper and lower scan electrode lines Y1~Ym/2 and Ym/2+1~Ym is changed whenever the scanning is turned to a next sub-field, while the scanning sequence for the upper scan electrode lines Y1~Ym/2 and the lower scan electrode lines Ym/2+

1~Ym are the same. That is, in all the sub-fields of the (n)th frame, the scan pulses SP are provided to the upper scan electrode lines Y1~Ym/2 and the lower scan electrode lines Ym/2+1~Ym progressively. However, in all the sub-fields of the (n+1)th frame, the scan pulses SP are provided to the upper scan electrode lines Y1~Ym/2 and the lower scan electrode lines Ym/2+1~Ym, reverse progressively.

Accordingly, though the third embodiment method for operating a PDP differ from the first embodiment in view of the scanning direction, since the scanning direction can be changed whenever the scanning is turned to a next sub-field, the high temperature mis-discharge can be prevented.

As a variation of the third embodiment, the scanning direction may be changed whenever the scanning is turned to a next frame or a group of a preset number of sub-fields, while the scanning direction of the upper scan electrode lines Y1~Ym/2 and the scanning direction of the lower scan electrode lines Ym/2+1~Ym are the same.

Though the embodiments of the present invention shows a case of a duel scanning method application, in which the scan electrode lines Y1~Ym are operated independently for two equal division of the scan electrode lines Y1~Ym of the upper scan electrode lines Y1~Ym/2 and the lower scan electrode lines Ym/2+1~Ym, the technical characteristics of the present invention can be applicable to the single scanning method.

As described, in the method for operating a PDP of the present invention, after the address discharge is progressed, while changing the scanning sequence whenever the scanning is turned to a next sub-field, a next frame, or a next group of a preset number of sub-fields in carrying out the address discharge, the sustain discharge is progressed. Thus, by reducing a loss of wall charges caused by the set up pulse in operating the PDP at a high temperature, the mis-discharge can be reduced and a uniform discharge characteristics can be provided.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A device for operating a plasma display panel (PDP) having sustain electrode lines, upper and lower address electrode lines, and a plurality of successive upper scan electrode lines and a plurality of successive lower scan electrode lines, comprising:

a first Y operating part for providing a scan pulse to the upper scan electrode lines, each of the successive upper scan electrode lines being provided with a first scan pulse in a first sequence, the first sequence being changed at every new frame;

a second Y operating part for providing a scan pulse to the lower scan electrode lines, each of the successive lower electrode lines being provided with a second scan pulse in a second sequence, the second sequence being changed at every new frame;

a Z operating part for operating the sustain electrode lines;

a first X operating part for operating the upper address electrode lines; and a second X operating part for operating the lower address electrode lines, wherein the first and second sequences are changed at every new frame so that sequences of the first and second scan pulses applied in one sub-field of one frame are different from sequences of the first and second scan pulses applied in a same number sub-field in a succeeding frame.

2. The device as claimed in claim 1, wherein the first X operating part provides a first data pulse to the upper address electrode lines, and the second X operating part provides a second data pulse to the lower address electrode lines, wherein the first data pulse is synchronized with the first scan pulse, and the second data pulse is synchronized with the second scan pulse.

3. The device as claimed in claim 1, wherein the first sequence and the second sequence are opposite to each other.

4. The device as claimed in claim 1, wherein the first sequence and the second sequence are identical with each other.

5. A method for operating a plasma display panel having sustain electrode lines, upper and lower address electrode lines, and a plurality of successive upper scan electrode lines and a plurality of successive lower scan electrode lines, comprising:

(a) discharging all cells on a panel for resetting the panel;

(b) scanning each of the successive upper scan electrode lines in a first scan direction and scanning each of the successive lower scan electrode lines in a second scan direction opposite to the first scan direction;

(c) applying a first sustain pulse to the successive upper and lower scan electrode lines and a second sustain pulse to the sustain electrode lines;

(d) discharging all cells on the panel for resetting the panel;

(e) scanning each of the successive upper scan electrode lines in the second scan direction and scanning each of the successive lower scan electrode lines in the first scan direction; and (f) applying a third sustain pulse to the successive upper and lower scan electrode lines and applying a fourth sustain pulse to the sustain electrode lines, wherein the scan directions of the upper and lower electrodes are changed at every new frame, wherein the scanning in (b) and (e) is performed so that the upper and lower scan electrode lines are scanned in one sub-field of one frame in a sequence different from scanning of the upper and lower scan electrode lines in a same number sub-field in a succeeding frame.

6. A device for operating a plasma display panel (PDP) having sustain electrode lines, address electrode lines, and a plurality of successive scan electrode lines, comprising:

a Y operating part for providing a scan pulse to the scan electrode lines, each of the successive scan electrode lines being provided with the scan pulse in a sequence, the sequence being changed at every new frame;

a Z operating part for operating the sustain electrode lines; and an X operating part for operating the address electrode lines, wherein a sequence of scan pulses applied to the successive scan electrode lines in one sub-field of one frame is different from a sequence of scan pulses applied to the successive scan electrode lines in a same number sub-field in a succeeding frame.

7. The device as claimed in claim 6, wherein the X operating part provides a data pulse to the address electrode lines, wherein the data pulse is synchronized with the scan pulse provided from the Y operating part.

8. A method of operating a plasma display panel having sustain electrode lines, address electrode lines, and a plurality of scan electrode lines, comprising:

(a) applying a first scan pulse to each of the successive scan electrode lines sequentially in a first sequence; and (b) applying a second scan pulse to each of the successive scan electrode lines sequentially in a second sequence opposite to the first sequence, wherein the first sequence is alternated with the second sequence at every new frame so that the first scan pulse is applied in a sequence in one sub-field of one frame different from a sequence in which the second scan pulse is applied in a same number sub-field in a succeeding frame.

9. The method as claimed in claim 8, wherein data pulses are applied to the address electrode lines in synchronization to the first and second scan pulses applied to the successive scan electrode lines.

10. The method as claimed in claim 8, further comprising applying first, and second sustain pulses to the successive scan electrode lines and the sustain electrode lines after the first and second scan pulses are applied to the successive scan electrode lines.

11. The device as claimed in claim 1, wherein the same number sub-field is a first sub-field in said one and succeeding frames.

12. The device as claimed in claim 1, wherein the first and second sequences are changed at every new frame so that sequences of the first and second scan pulses applied in sub-fields of said one frame are different from sequences of the first and second scan pulses applied in correspondingly numbered sub-fields in the succeeding frame.

13. The method as claimed in claim 5, wherein the same number sub-field is a first sub-field in said one and succeeding frames.

14. The method as claimed in claim 5, wherein the scanning in (b) and (e) is performed so that the upper and lower scan electrode lines are scanned in sub-fields of said one frame in a sequence different from scanning of the upper and lower scan electrode lines in correspondingly numbered sub-fields in the succeeding frame.

15. The device as claimed in claim 6, wherein the same number sub-field is a first sub-field in said one and succeeding frames.

16. The device as claimed in claim 6, wherein the sequence of scan pulses applied to the successive scan electrode lines in sub-fields of said one frame is different from a sequence of scan pulses applied to the successive scan electrode lines in correspondingly numbered sub-fields in the succeeding frame.

17. The method as claimed in claim 8, wherein the same number sub-field is a first sub-field in said one and succeeding frames.

18. The method as claimed in claim 8, wherein the first scan pulse is applied in sub-fields of one frame in a sequence different from a sequence in which the second scan pulse is applied in correspondingly numbered sub-fields in the succeeding frame.

19. The device as claimed in claim 1, wherein the second Y operating part is separate from the first Y operating part and the second X operating part is separate from the first X operating part.

20. The device as claimed in claim 1, wherein said every new frame consists of an even number of sub-fields.

* * * * *